US006286193B1

(12) United States Patent
Dobrikow et al.

(10) Patent No.: US 6,286,193 B1
(45) Date of Patent: Sep. 11, 2001

(54) APPARATUS FOR MECHANICAL JOINING

(75) Inventors: Matthias Dobrikow, Osterode; Uwe Kutzmutz, Herzberg, both of (DE)

(73) Assignee: Eckold GmbH Co. KG, St. Andreasberg (DE)

( * ) Notice: Subject to any disclaimer, the term of this patent is extended or adjusted under 35 U.S.C. 154(b) by 0 days.

(21) Appl. No.: 09/443,951

(22) Filed: Nov. 19, 1999

(30) Foreign Application Priority Data

Nov. 20, 1998 (DE) ..... 198 53 553

(51) Int. Cl.[7] ..... B25C 7/00
(52) U.S. Cl. ..... 29/243.5
(58) Field of Search ..... 29/293.5, 283.5, 29/21.1, 522.1, 529.1, 509

(56) References Cited

U.S. PATENT DOCUMENTS 4,409,720 * 10/1983 Boudreau ..... 29/243.5
5,581,860 12/1996 Sawdon ..... 29/243.5

FOREIGN PATENT DOCUMENTS 3131301 2/1983 (DE) ..... B21D/39/03
3210956 9/1983 (DE) ..... B21D/39/03

* cited by examiner

*Primary Examiner*—Robert C. Watson
(74) *Attorney, Agent, or Firm*—Townsend and Townsend and Crew LLP

(57) ABSTRACT

The invention relates to an apparatus for mechanically joining metal sheets which lie flat one upon the other, having a tool set comprising at least one punch and one die which bounds a cavity in which the joining operation takes place, the punch displacing sheet-metal material out of a sheet-metal plane and upsetting it, and at least one tool part being arranged, for this purpose, on a displaceable tool carrier which has a holding-down means supported in a spring-prestressed manner adjacent to the tool part. In order that the holding-down means allows high outputs, it is provided that, for the spring prestressing of the holding-down means, the tool carrier has a cylinder cavity in which there is guided a piston which acts on the holding-down means and on the head side bounds, with volume-changing action, a pressure chamber which can be subjected to the action of a fluid pressure medium.

5 Claims, 1 Drawing Sheet

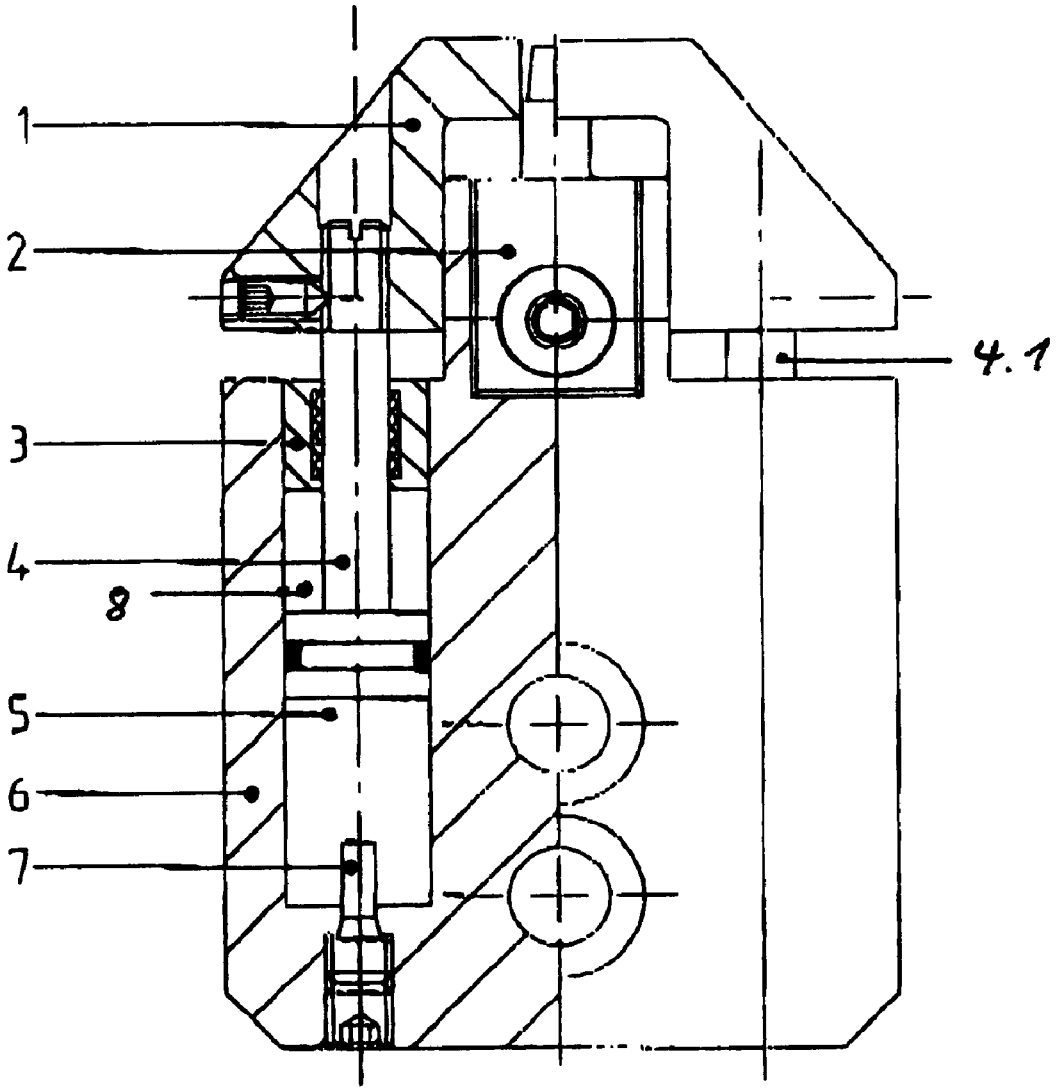
1
2
3
4
8
5
6
7
4.1

APPARATUS FOR MECHANICAL JOINING

The invention relates to an apparatus for mechanical joining.

Known apparatuses for mechanical joining essentially comprise a punch, a die and often also a holding-down means. As is known from U.S. Pat. No. 5,581,860, the holding-down means serves for applying a pre-selected contact-pressure force in the immediate area of a joining operation which is to be carried out and for acting as a stripper at the end of a joining operation, in order to strip the punch from the metal sheets. In this case, the force of the holding-down means is produced by a spring-pressure device with a central spring, for example in the form of a helical spring. The disadvantage here is that strippers which utilise helical springs involve large outputs and are prone to failure.

An object of the invention is thus to provide an apparatus for mechanical joining in which the holding-down means allows high production outputs.

The present invention provides an apparatus for mechanically joining metal sheets which lie flat one upon the other, having a tool set comprising at least one punch and one die which bounds a cavity in which the joining operation takes place, the punch displacing sheet-metal material out of a sheet-metal plane and upsetting it, and at least one tool part being arranged, for this purpose, on a displaceable tool carrier which has a holding-down means supported in a spring-prestressed manner adjacent to the tool part, characterized in that, for the spring-prestressing of the holding-down means, the tool carrier has a cylinder cavity in which there is guided a piston which acts on the holding-down means and on the head side bounds, with volume-changing action, a pressure chamber which can be subjected to the action of a fluid pressure medium.

An apparatus for mechanical joining according to the invention has holding-down means which do not include metallic springs and utilizes the compressibility of suitable gaseous or liquid media which are introduced in each case into a pressure chamber which is integrated in the displaceable tool carrier and is bounded with volume-changing action by a piston which acts on the holding-down means. The production outputs are increased to a considerable extent by such a spring-pressure device. In addition, constant spring forces are achieved over the relatively long service life.

The spring characteristic is flatter, with the result that high contact-pressure forces can be applied even initially. The manner and extent of the pressure-medium action also allow the spring characteristic and the maximum spring force to be set, as a result of which adaptation to a respective joining task is possible. This is important, in particular for the joining of aluminium since, in this case, relatively high stripper forces are required in order for the metal sheet, which more can stick on the punch, to be stripped off.

Further advantages reside in the considerably smaller amount of installation space in relation to prior-art spring-pressure devices. Maintenance is simplified since repair is possible by exchanging individual installation elements and renewed pressure-medium introduction.

Further configurations of the invention can be gathered from the following description and the claims.

The attached drawing shows, schematically, a displaceable tool carrier of an apparatus for mechanical joining, which is described hereinbelow.

The invention relates to an apparatus for mechanically joining metal sheets which lie flat one upon the other, having a tool set comprising at least one punch 2 and one die (not illustrated) which bounds a cavity in which the joining operation takes place, the punch 2 displacing sheet-metal material out of a sheet-metal plane and upsetting it, and at least one tool part being arranged, for this purpose, on a displaceable tool carrier 6.

In the case of a tool carrier 6 which is illustrated in the attached drawing, the punch 2 is fastened on said tool carrier and can be displaced axially therewith by virtue of a stroke movement of the tool carrier 6. Alternatively, the tool part on the displaceable tool carrier 6 may also be formed by the die.

Adjacent to the punch 2, a holding-down means 1 is supported in a spring-prestressed manner on the tool carrier 6. The holding-down means 1 can thus be displaced relative to the punch 2, to be precise by a spring-pressure device which acts on the holding-down means 1. The spring-pressure device comprises at least one cylinder cavity 8 which is integrated in the tool carrier 6 and in which there is guided in a displaceable manner a piston 4 which bears the holding-down means 1 at one piston-rod end. The piston 4 is guided via a guide bushing 3 which closes off the cylinder cavity 8 at the bottom.

On the head side, the piston 4 incorporates a pressure chamber 5 in a fluid-tight manner, with the result that the pressure chamber 5 is closed off since the cylinder cavity 8 is also closed off on the head side. Just one valve 7 is provided for subjecting the pressure chamber 5 to the action of a fluid pressure medium, in particular a gas or a liquid with suitable compressibility, (or for exchanging said pressure medium). The cylinder cavity 8 runs axially, with the result that, in the case of a stroke movement of the tool carrier 6, the piston 4 is displaced in the cylinder cavity 8 when the holding-down means 1 together with the tool carrier 6 is positioned against metal sheets which are to be joined. The resistance acting against the holding-down means 1 as a result of the metal sheets (not illustrated) results in the piston 4 working, against the stroke direction, against the fluid pressure medium in the pressure chamber 5, as a result of which the spring force can assume its maximum value. The pressure medium is selected such that the holding-down means 1 can exert contact pressures of up to 3000 N.

At the end of a joining operation, the above described holding-down means 1 acts as a stripper in that the piston 4, once again, works against the pressure chamber 5 when the punch 2 is moved back in relation to the holding-down means 1 and the movement of holding-down means 1 relative to punch 2 is prevented by adhering metal sheets. The spring force acting on the holding-down means 1 strips off the metal sheets from the punch 2. Spring forces of 600–800 N are sufficient per individual clinch for steel, but the required spring forces for aluminium range between 800 and 2500 N, depending on the material and sheet-metal thickness.

The cylinder cavity 8 integrated in the tool carrier thus allows the installation of a spring-pressure device in the manner of a pneumatic spring which bears the holding-down means 1.

In order to have direct action of the spring force, the piston 4 can be displaced against a stop (not illustrated) which holds the piston 4 in a spring-prestressing position.

Further preferred is the use of two spring-pressure devices of the type described above, as is indicated by the illustration of a second piston 4.1 in the attached drawing.

Furthermore, the pressure-medium action can be controlled via the valve 7, with the result that selectable spring forces can be set.

Although the invention has been described in some detail by way of illustration and example, for purposes of clarity and understanding, it will be obvious that certain changes and modifications may be practiced within the scope of the invention.

What is claim:

1. Apparatus for mechanically joining metal sheets which lie flat one upon the other, having a tool set comprising at least one punch and one die which bounds a cavity in which the joining operation takes place, upsetting it, a displaceable tool carrier, at least one tool part being arranged, for this purpose, on the displaceable tool carrier, and a holding-down means supported in a spring-prestressed manner on the tool carrier adjacent to the tool part, wherein for the spring-prestressing of the holding-down means, the tool carrier has a cylinder cavity in which there is guided a piston which acts on the holding-down means and on the head side bounds, with volume-changing action, a pressure chamber which receives a fluid pressure medium, wherein the tool carrier has two mutually opposite cylinder cavities with associated pistons which both act on the holding-down means.

2. Apparatus according to claim 1, further comprises a valve connected to fill the pressure chamber.

3. Apparatus according to claim 2, wherein the pressure-medium action can be controlled via the valve.

4. Apparatus according to claim 1 or 2, wherein the piston is guided on the tool carrier via a guide bushing.

5. Apparatus according to claim 1 or 2, wherein the pistons are displaced against a stop for spring prestressing.

* * * * *